US005469642A

United States Patent [19]

Farbman

[11] Patent Number: 5,469,642

[45] **Date of Patent: * Nov. 28, 1995**

[54] MARCHING SHOES

[76] Inventor: Jon Farbman, 344 Ocean Blvd., Atlantic Highlands, N.J. 07716

[ * ] Notice: The portion of the term of this patent subsequent to Jul. 10, 2007, has been disclaimed.

[21] Appl. No.: 810,567

[22] Filed: Dec. 20, 1991

Related U.S. Application Data

[60] Continuation of Ser. No. 549,415, Jul. 6, 1990, abandoned, which is a division of Ser. No. 352,620, May 15, 1989, Pat. No. 4,939,853, which is a continuation of Ser. No. 139,653, Dec. 30, 1987, abandoned.

[51] Int. Cl.[6] ..... A43B 3/00; A43B 13/00

[52] U.S. Cl. ..... 36/103

[58] Field of Search ..... 36/114, 30 R, 36/25 R, 103, 113; D2/310

[56] References Cited

U.S. PATENT DOCUMENTS

| | | | |
|---|---|---|---|
| D. 249,298 | 9/1978 | Senter | 36/113 |
| 2,773,316 | 12/1956 | Clappier | 36/30 R |
| 4,041,619 | 8/1977 | Sapper | 36/25 R |
| 4,130,947 | 12/1978 | Dean | 36/32 R |
| 4,364,188 | 12/1982 | Turner et al. | 36/30 R |
| 4,494,322 | 1/1985 | Klagmann | 36/32 R |
| 4,562,651 | 1/1986 | Frederick et al. | 36/25 R |
| 4,667,423 | 5/1987 | Autry et al. | 36/25 R |
| 4,939,853 | 7/1990 | Farbman | 36/113 |

FOREIGN PATENT DOCUMENTS

| | | | |
|---|---|---|---|
| 2502913 | 10/1982 | France | 36/25 R |

*Primary Examiner*—Steven N. Meyers
*Attorney, Agent, or Firm*—Franklyn Schoenberg; Norman E. Lehrer

[57] ABSTRACT

A formal marching shoe suitable for use in "corps style" marching maneuvers having a heel-free outer soleunit with a substantially planar ground engaging bottom surface, the shoe upper having a close encircling foot enclosure adapted for closing in a conventional manner by laces and the outer soleunit of the shoe extending upwardly in a curving, arcuate course from the rear heel-receiving end of the shoe to joinder with the outer surface of the rear of the shoe upper.

1 Claim, 3 Drawing Sheets

MARCHING SHOES

This application is a continuation of application Ser. No. 549,415, filed Jul. 6, 1990 now abandoned, which is a division of application Ser. No. 352,620 filed May 15, 1989 now U.S. Pat. No. 4,939,853, which is a continuation of application Ser. No. 139,653 filed Dec. 30, 1987 now abandoned.

FIELD OF THE INVENTION

The present invention relates to improvements in shoes and more particularly, to a formal shoe having a heel-free, flat sole configuration for use by members of bands, drum and bugle corps and other marching groups.

BACKGROUND OF THE INVENTION

Over the years, a multitude of shoe designs have been advanced with varying regard to style, comfort and utility. In some instances, utilitarian, functional and/or performance considerations have been almost totally disregarded in favor of style. As a related aspect, the structural features of a shoe are not always compatible in providing comfort while supporting the foot for rigorous movement or for permitting certain activities to be carried out effectively, and for extended periods. That is, a comfortable shoe may well impede the wearer in moving effectively, particularly when used in precise, rapid activity such as marching or its use may be physically detrimental to the foot, leg or back.

In recent years, considerable emphasis has been placed on the development of improved shoes for athletic activities. In this regard, a number of specialized shoes have been developed and a variety of structures have been proposed for incorporation in such shoes. These suggestions have addressed the problems of footwear construction primarily from the point of view of the configuration of the surface in contact with the footwear and/or the wearer's foot and its ability to meet the demands of normal or running gait; other suggestions have addressed the problem of footwear construction mainly from the viewpoint of the materials of construction. However, while these prior art approaches represent significant contributions and are directed to a wide range of activities such as running, walking, bowling, aerobics, wrestling, golf, driving, dancing and the like, casual appearance is generally desirable because of the environment of such activities.

Conventional shoes, where formal appearance is important have received only limited attention and, typically, have regular flat-bottomed and elevated heels and separate soles. Moreover, a conventional or formal shoe is not disclosed which addresses both shoe construction and configuration that may be employed by marching groups, particularly band marching organizations.

Footwear used by marching groups must meet many specific demands, including comfort and support to avoid fatigue, foot control to match the marching style and environment and yet permit a high degree of maneuverability in forward and rearward movements, and appearance to meet a generally formal rather than informal environment. Particularly, in light of the wide use of more demanding marching styles; including what is termed "corps style" in which the "glide-step" is the basic movement, the footwear used is of increasing importance. Such marching style involves extremely complex accelarations/decelerations, turns and slides being performed which require high velocity foot placements and extremely smooth gliding-like (rolling) foot movements together with graceful body movements.

Recently, attempts have been made by bands and other marching groups to use footwear designed to meet various athletic requirements, or that are generally light in weight and considered more comfortable, or that are useful in a variety of outdoor environments. In general such footwear have achieved only limited functional success and, further do not provide the formal appearance most often desired with "dress uniforms" and the variety of marching styles and environments in which marching bands or the like are performing. Such footwear are either too heavy and uncomfortable, generally inhibit maneuverability, and/or are incompatible with "corps style" marching and promote fatigue.

More recently, a novel midi-boot construction having strap-fastening means, a flat sole and rounded heel and toe configurations has been promoted for use by marching bands and found to exhibit a number of surprising advantages compared to other footwear styles and construction, including permitting marching groups to improve performance during certain maneuvers and to generally reduce fatigue. However, such midi-boot construction generally does not meet the desired appearance for use with the "dress uniform" of many groups or as a conventional shoe. In addition, the high uppers (midi-boot construction) interfere with the trouser legs of "dress uniforms," the strap fastening means did not provide the positive foot location within the footwear generally desired for complex maneuvers, both forward and rearward, and the particular rounded heel and toe construction and configuration resulted in damage to the uppers of the footwear.

SUMMARY OF THE INVENTION

It is an object of the present invention to provide a formal marching shoe which is of the low-cut type, light in weight, comfortable, will provide positive support for a users foot while performing on a variety of hard, artificial and outdoor surfaces, will promote maneuverability in backward and forward directions and conforms generally with the appearance of "dress uniforms."

It is a further object of the present invention to provide a marching shoe of the low-cut type which is compatible in appearance with "dress uniforms," is light in weight and comfortable to wear, uses laces to tie and provide support for and positive location of the foot of the wearer, has a heel-free, solepiece with a substantially planar ground engaging bottom surface which extends upwardly at the heel end portion in a curving course from the solepiece bottom surface to join with the rear of the upper portion of the shoe to prevent any impediment to the wearer in moving effectively in a variety of different forward and backward maneuvers.

It is a still further object of the present invention to provide a low-cut formal marching shoe which is secured by laces about the foot of a wearer, has a solepiece with a heel-free, substantially planar ground engaging bottom surface which extends upwardly in an arcuate course from the solepiece surface to join with the rear of an upper portion of the shoe and is secured to a midsole having a substantially planar bottom surface extending from the heel section to the toe section of the shoe.

Still another object of the invention is to provide a lightweight marching shoe of the low-cut type which is compatible in appearance with "dress uniforms," has lace fastening means for securing the shoe above the foot of a wearer, has a heel-free solepiece with a substantially planar ground engaging bottom surface which extends upwardly in an arcuate course from the heel portion of the solepiece bottom surface to join with the rear of the upper portion of the shoe and which extends in a gradual upward course from the solepiece bottom surface to join with the toe end of a midsole secured between the shoe upper and the solepiece.

A still further object of the present invention is to provide a formal marching shoe of the low-cut type having lace means for securing the shoe about the foot of a wearer, a midsole having a substantially planar bottom surface and a gradually downwardly sloping upper surface which is secured to a shoe upper, a substantially heel-free solepiece having a planar ground engaging surface which extends in an upward arcuate course from the heel-receiving section of the solepiece to join with the heel end of the upper part of the shoe, and a notch or indentation extending: across the width of the solepiece transverse to the length of the shoe intermediate the heel end and toe end of the shoe.

In accordance with the present invention a formal marching shoe is provided which comprises:

(a) a shoe upper portion having a close encircling foot enclosure including a counter section at the rear which overlies a heel receiving region, a low-cut mid-body rear quarter section, a front quarter section having a plurality of eyelets for receiving laces, and a toe-box section;

(b) a midsole secured to said upper having an essentially planar bottom surface extending from the region below the counter section at the rear forwardly to the toe-box section; and (c) an elongated outer solepiece secured to said midsole having a substantially planar ground engaging bottom surface extending from the toe-box section to the rear heel-receiving region and which extends upwardly in a curving course from the heel-receiving region of the solepiece bottom surface and is joined with an outer surface of the counter section at the rear of said upper.

The marching shoe of the invention provides a low-cut formal shoe which may be light-weight in construction and has lacing support for the shoe upper about the foot of a wearer. The shoe has a heel-less substantially planar ground engaging bottom surface extending from the toe end to the heel-receiving end of the shoe and an arcuately curved (rolled) heel-end which wraps up over the heel-end and counter section of the shoe enabling the wearer to perform a smooth rolling "glide" step. Thus, the shoe of the invention has an essentially completely flat and heel-less sole which avoids impeding slides, turns and rolling movements, and in fact promotes such movements, while permitting positive feel and maximum control by the wearer on a variety of artificial and natural surfaces. The solepiece is, preferably, thin to permit flexibility and graceful, flowing and precise moves while being thick enough for everyday wear.

In another form, the invention provides that the solepiece intermediate the rear counter section and the front toe-box end and preferably underlying the juncture of the mid-body quarter and front quarter sections, includes a notch or indentation extending across the width of the solepiece transverse to the length of the shoe. In other words, the solepiece includes a "spat-notch" for retaining the hold-down straps of "spats" or the like decorative adornments of "dress uniforms" where they may be used by a marching band or similar group.

In a still further form, the invention provides that the front end of the solepiece follows a gradual upward course from the solepiece bottom surface to join with the toe-end of a inidsole secured between the shoe upper portion and the solepiece to provide a "rolling" front end.

Other objects and advantages of the present invention will be apparent from the following detailed description of preferred embodiments taken in conjunction with the drawing.

DESCRIPTION OF PREFERRED EMBODIMENTS

Figure 1:
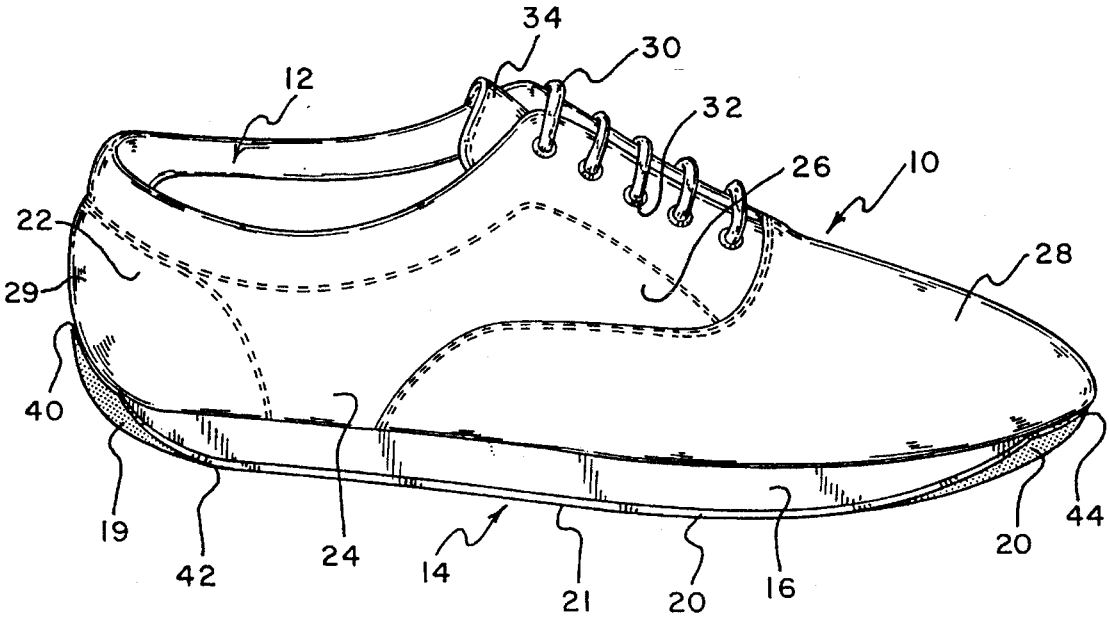
FIG. 1 is a perspective view of a formal marching shoe for the right foot in accordance with the present invention.

Referring now to the drawings wherein like numerals indicate like elements, there is shown in FIGS. 1 to 4 a low-cut formal marching shoe in accordance with the present invention designated generally as 10. The shoe 10 includes a shoe upper portion 12 which may be made of leather or similarly strong and relatively inextensible material, to which a multi-layered sole unit 14 is attached by bonding or other conventional means. The multi-layered sole unit 14, which will be described in greater detail hereinafter, includes an outer solepiece layer 20 extending the entire length of the shoe 10 and a midsole layer 16 extending substantially the entire length of the shoe upper between the shoe upper 12 and the outer solepiece 20. The outer solepiece layer 20 is preferably made of a conventional hard, resilient and flexible wear-resistant material, such as rubber or a comparable synthetic material. A midsole layer 6, need not be hard as the outer solepiece 20, but should be resilient and cushioning to absorb the hocks of marching, including rapid maneuvering, fast tempos and the like, over a variety of natural and artificial turf and the like surfaces. Midsole 16 is preferably formed of a single layer with a substantially planar bottom from a cushioning resilient material such ethylene-vinylacetate EVA), foamed polyurethane or the like.

The shoe upper portion 12 is formed to enclose the foot of the wearer and includes in conventional fashion a foot receiving opening, a counter section 22 at the rear which overlies the heel region of the sole unit and extends forwardly, the upper further having mid-body rear quarter and front quarter sections 24 and 26. The front quarter section 26 terminates juncture with a toe box or front section 28 and adapted for closing in a conventional manner by laces passed through eyelets 32. The shoe upper 12 includes the usual tongue 34.

As indicated, the multi-layer sole unit 14 is formed by a midsole layer 16 which is secured to the shoe upper with a peripheral line of demarcation therebetween and an outer solepiece layer 20, such solepiece including a ground engaging and gripping surface 21. Outer solepiece 20 is made up of a resilient, wear resistant material of general uniform thickness over its length. The ground engaging bottom surface 21 can be of any desired design for traction, but is substantially planar over its length. The thickness of the solepiece 20 is not critical and can be varied depending on the material used, the type of surface upon which the shoe will be used, and the desired wear-life, flexibility, and weight thereof. In general the-thickness of the solepiece 20 may range from about ⅛" to about ¼", or even thicker.

The midsole layer 16, which is disposed between the shoe upper and the outer solepiece comprises a generally unitary construction extending substantially the entire length of the shoe upper 12 with a substantially planar bottom surface. Midsole layer 16 may be of a generally uniform thickness over its entire length or it may be made with a gradually downwardly sloping upper surface extending forwardly from the heel-receiving region of the sole between the counter section 22 and the toe-box or front section 28 of the shoe. The thickness of the midsole layer 16 can be varied depending on the type of material used and the degree of cushioning needed, i.e., it may be about the same thickness as the outer solepiece, e.g. from about ⅛" to ¼" thick, or may be about 2 to 4 times the thickness of the solepiece 20, i.e. to about ½" in thickness. Where the midsole layer 16 is made with a gradually downwardly sloping upper surface, the thickness thereof may range from about ⅜" to ½" at its heel-receiving region to about ⅛" to ⅜" at the toe-box or front section 28 of the shoe.

The essentially heelless structure of the multi-sole unit 14 having a substantially flat, planar ground engaging surface, affords the wearer better control during a multitude of maneuvers which a marching group performs on artificial and natural surfaces. However, in order for a marching group to perform many of the intricate rearward and forward maneuvers required naturally, rapidly and without disrupting the wearers foot movements or concentration, it is very important that the rearward end of the heel-receiving portion of the shoe be rounded or rolled as will be seen in FIGS. 1 to 4 to permit the foot of the wearer to "roll" into and out of each "glide" step with a flowing movement.

In accordance with the invention, the end and edges of the outer solepiece 20 under the counter section 22 in the heel-receiving section of the shoe extend upwardly in a curving course about the periphery of the midsole 16 from the solepiece surface 21 to joinder with the peripheral edge of the midsole and the outer surface 29 of the counter section 22, with at least a substantial part of the rearward end 19 of the outer solepiece bottom surface also following an arcuate course about the periphery of the heel-receiving section of the multi-layered sole unit 14. In such manner, the heel-free solepiece bottom surface is in a smooth rolling contact course with the ground surface permitting flowing intricate forward and rearward moves by the wearer regardless of the particular gait of the wearer.

Figure 2:
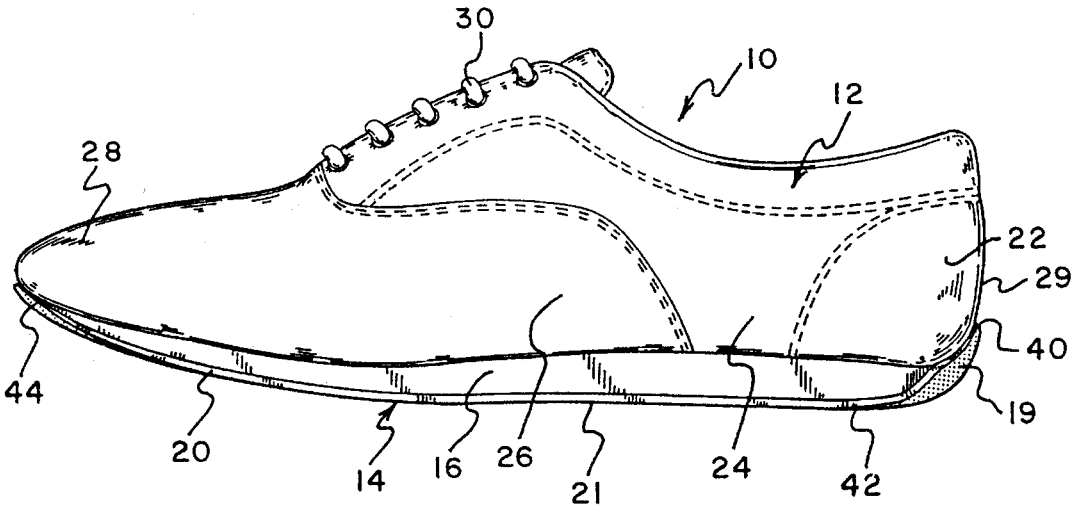
FIG. 2 is an elevation view of the right-side of the marching shoe of FIG. 1.
Figure 3:
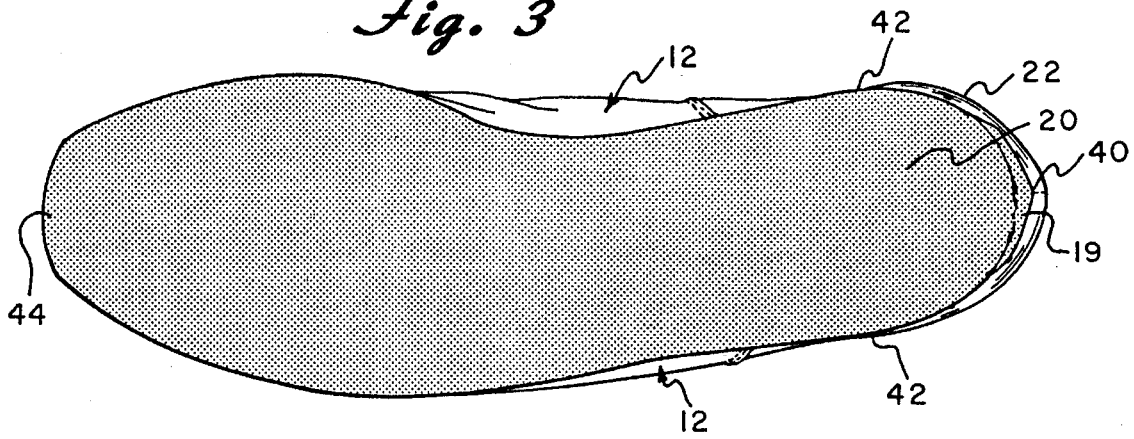
FIG. 3 is a bottom view of the marching shoe of FIG. 1.
Figure 3A:
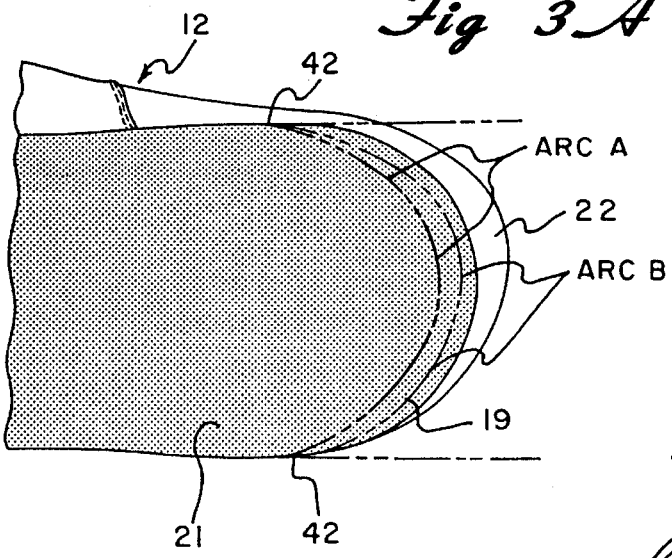
FIG. 3A is an enlarged partial bottom view of the marching shoe of FIG. 1.
Figure 4:
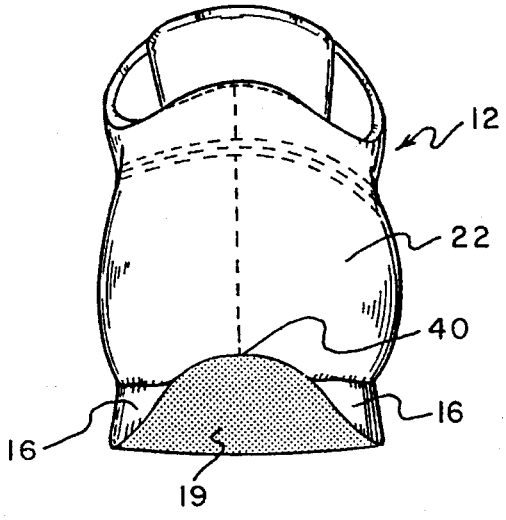
FIG. 4 is a back end view of the march shoe of FIG. 1.

The upwardly extending solepiece about the counter section and rear-end of the midsole tapers from a maximum height at point 40 on the surface 29 of counter section 22 forward to a minimum height of about zero at point 42 which is substantially at the widest point of the heel-receiving section of the outer solepiece 20 and with the end section of the solepiece beneath the midsole generally defining an arc A smaller than the arc B defined by the joinder end of the shoe upper and the multi-layer sole unit 14 (FIG. 3A). It is advantageous for the end section 19 of the solepiece to extend upwardly about at least a small portion of the surface 19 of the counter section 22 to provide sufficient wear resistance thereto but the amount of counter section surface covered is not critical and may be varied according to the appearance desired. The solepiece extending onto the surface of the counter section may be joined thereto by bonding or other conventional means, While it is not essential, it has been found advantageous for the solepiece at the toe end of the shoe to follow a generally arcuate upward course as shown in FIG. 2, and to join the toe or front end 44 of the midsole 16 about the periphery thereof. This "rolling" front end of the outer solepiece further enhances the maneuverability of a wearer in performing intricate marching steps. It is generally preferable that the upwardly extending solepiece does not extend onto the toe-box end 28 of the upper since damage to the surface or separation of the solepiece may occur.

Figure 5:
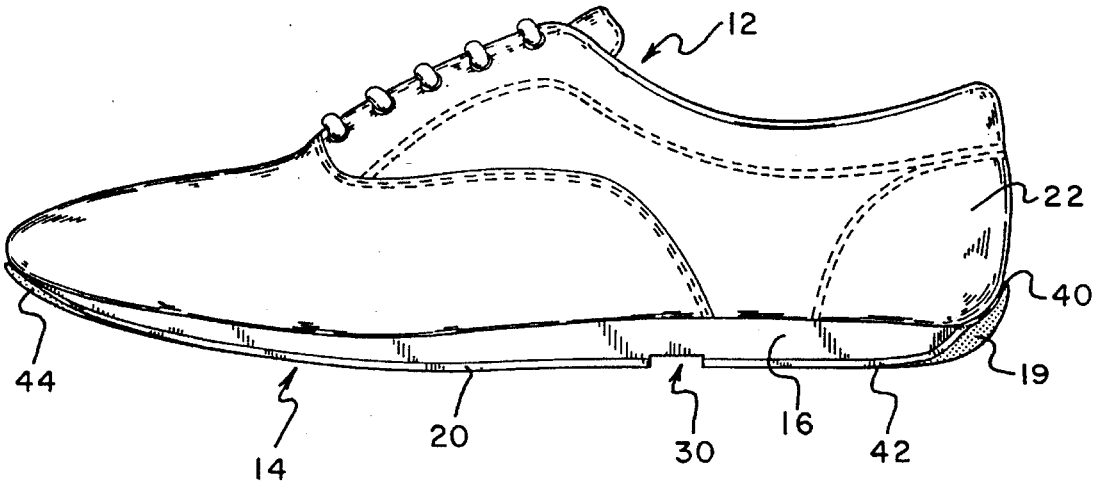
FIG. 5 is an elevation view of the left-side of an alternate embodiment of a formal marching shoe in accordance with the invention.
Figure 6:
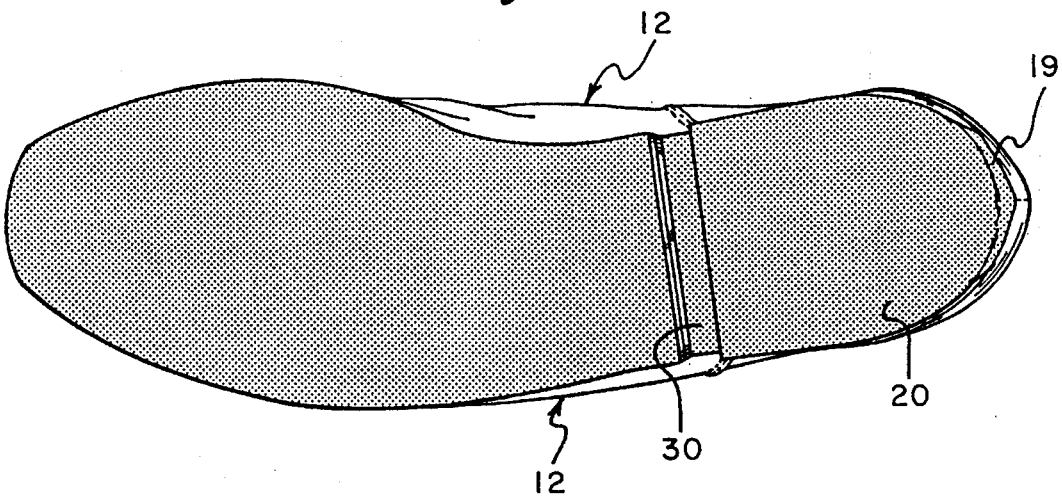
FIG. 6 is a bottom view of the marching shoe of FIG. 5.

In an alternate embodiment of the marching shoe of the invention reference is made to FIGS. 5 and 6 where there is illustrated a marching shoe 10 comprising the sections of the upper 10 and multi-layered sole unit 14 as shown in FIGS. 1 to 4 and where there is formed a "notch" 50 which extends across the width of the sole unit 14 generally beneath the juncture of the mid-body and front quarter sections in a wearers arch receiving region of the sole unit 14. As shown, the notch is of rectangular cross-section and of a size suitable to receive a "hold-down" strap attached to a "spat" or similar decorative adornment that may be worn as a part of a "dress uniform." The depth of the notch should be sufficient to completely receive and protect such a "hold-down" attachment against undue wear or unexpected displacement during marching. Generally, the "notch" will be formed entirely within the outer solepiece 20, but the depth thereof may be extended into the bottom of the midsole 16 for certain uses. It would be evident to those skilled in the art that an indentation in the solepiece may also be used to provide the "spat notch" feature.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size and arrangement of parts, within the principle of the invention.

What is claimed is:

1. A formal dress marching shoe which comprises:

(a) a low-cut formal dress shoe upper portion which is formed of a strong, substantially inextensible dressy material compatible with a "formal dress uniform", having a close encircling foot enclosure including a counter section at the rear which overlies a heel receiving region, a mid-body rear quarter section, a front quarter section with a plurality of eyelets for receiving laces, and a toe-box front section;

(b) a midsole having a foot bearing surface and a bottom surface, said midsole being secured to said upper portion with a peripheral line of demarcation formed substantially therebetween and extending from the heel receiving region below the counter section at the rear forwardly to the toe-box section; and (c) an elongated outer solepiece secured to and substantially covering said midsole bottom surface from the rear heel receiving region below the counter section forwardly to the toe-box section and with said solepiece extending upwardly about said midsole in a curving arcuate course from said heel-receiving region to about a portion of an outer surface of the counter section at the rear of said upper but wherein no portion of the forward end of said solepiece extends about any peripheral portion of the toe-box section of the upper; which thereby permits a wearer of said shoe to perform "corps style" and complex marching band maneuvers; said formal marching shoe including an indentation substantially in the outer solepiece extending across the width thereof transverse to the length of the shoe generally beneath a wearer's arch receiving region of the solepiece suitable to receive a "hold-down" strap.

* * * * *